US007589603B2

(12) United States Patent
Tae et al.

(10) Patent No.: US 7,589,603 B2
(45) Date of Patent: Sep. 15, 2009

(54) PHASE SHIFTER HAVING POWER DIVIDING FUNCTION FOR PROVIDING A FIXED PHASE SHIFT AND AT LEAST TWO PHASE SHIFTS BASED ON PATH LENGTH

(75) Inventors: Jae-Hoon Tae, Incheon (KR); Yong-Ju Lee, Seoul (KR); Myoung-Kuk Kim, Incheon (KR); Joo-Sung Park, Busan (KR); Joo-Hyung Lee, Incheon (KR)

(73) Assignee: Ace Technology, Incheon (KR)

( * ) Notice: Subject to any disclaimer, the term of this patent is extended or adjusted under 35 U.S.C. 154(b) by 158 days.

(21) Appl. No.: 10/564,396

(22) PCT Filed: Jul. 14, 2004

(86) PCT No.: PCT/KR2004/001744

§ 371 (c)(1),
(2), (4) Date: Jan. 13, 2006

(87) PCT Pub. No.: WO2005/006489

PCT Pub. Date: Jan. 20, 2005

(65) Prior Publication Data

US 2006/0164185 A1 Jul. 27, 2006

(30) Foreign Application Priority Data

Jul. 14, 2003 (KR) ..... 10-2003-0047761

(51) Int. Cl.
*H01P 1/18* (2006.01)

(52) U.S. Cl. ..... 333/156; 333/161

(58) Field of Classification Search ..... 333/156, 333/161

See application file for complete search history.

(56) References Cited

U.S. PATENT DOCUMENTS

2003/0076198 A1* 4/2003 Phillips et al. ..... 333/161
2006/0273864 A1* 12/2006 Zimmerman et al. ..... 333/161

FOREIGN PATENT DOCUMENTS

JP 06-196927 A 7/1994
JP 09 246846 A 9/1997
JP 11-355038 A 12/1999

(Continued)

*Primary Examiner*—Benny Lee
(74) *Attorney, Agent, or Firm*—Venable LLP; Michael A. Sartori; Yao Wang

(57) ABSTRACT

Disclosed is a phase shifter having a power dividing function. The phase shifter includes: an input port for receiving a radio frequency (RF) signal; a power dividing unit for dividing the RF signal into a first divided signal of which phase is to be varied and a second divided signal having a fixed phase value; a first output port for outputting the second divided signal having the fixed phase value; a phase shift unit for dividing the first divided signal into a third divided signal and a fourth divided signal wherein the third divided signal and the fourth divided signal move in opposite directions; a phase delay unit for shifting phase of the third divided signal and the fourth divided signal based on a difference in a path length of the third divided signal and the fourth divided signal, to thereby generate phase-shifted signals; and at least two second output ports connected to the phase delay unit, for outputting the phase-shifted signals.

29 Claims, 10 Drawing Sheets

FOREIGN PATENT DOCUMENTS

| | | | |
|---|---|---|---|
| JP | 2001 211025 | A | 8/2001 |
| KR | 2002-0041609 | | 6/2002 |
| KR | 2003-0081626 | A | 10/2003 |
| WO | WO 01/13459 | A | 2/2001 |
| WO | WO 03/019720 | A | 3/2003 |

* cited by examiner

PHASE SHIFTER HAVING POWER DIVIDING FUNCTION FOR PROVIDING A FIXED PHASE SHIFT AND AT LEAST TWO PHASE SHIFTS BASED ON PATH LENGTH

TECHNICAL FIELD

The present invention relates to a phase shifter; and, more particularly, to a phase shifter having power dividing function, which performs tilting of a vertical radiation beam in a base station of a mobile communication system.

BACKGROUND ART

In general mobile communication systems, since a density of subscribers is different at every region and at every time, the tilt control is frequently required in order to optimize the mobile communication system. For optimization of the air interface network, in a conventional mobile communication system, a mechanical tilt is used. The beam tilt of the antenna in a vertical direction means an angle of the beam radiated by the antenna slopes to the horizontal.

A conventional antenna is mechanically tilted to vary the radiated beam tilt of the antenna, using a mechanical tilting device mounted on the antenna.

Mechanical tilting of the antenna is a cost-effective way to manufacture the antenna. However, in this case personnel have to climb up toward the antenna to manually adjust antenna beam tilt. It is neither economically viable nor time-conscious. In other words, when the beam tilt of the antenna is required, the person should climb up toward the antenna, unfasten bolts fixing the tilting apparatus, adjust the angle of the antenna, and fasten the bolts, which takes much more time to tilt the antenna.

To solve the abovementioned problem, an electric beam tilting device capable of adjusting antenna beam tilt at a distance is developed. Such electric beam tilting device includes a phase shifter for shifting a phase of the beam radiated by the antenna.

A phase shifter for adjusting antenna beam tilt is disclosed in Korean Patent Laid-open No. 2002-0041609 which describes the phase shifter in which the beam tilt is varied by both adjusting the phase of the radio waves radiated by the antenna and controlling the power division.

FIG. 1 is a view showing a conventional phase shifter.

As shown, the conventional phase shifter includes a power divider 51, a first phase shift unit 52, a second phase shift unit 53, a first delay unit 54 and a second delay unit 55.

A radio signal is fed into the power divider 51 via an input port (IP). The power divider 51 divides up the radio signal in a predetermined ratio and then feeds them into the first and second phase shift units 52 and 53. The first phase shift unit 52 adjusts the phase of the radio signal and then sends it out to both a first output port (OP3) and a second output port (OP4). The second phase shift unit 53 divides the radio signal into two separate parts moving away in opposite directions to obtain phase shifts between them. The first and second delay units 54 and 55 are electrically connected to the second phase shift unit 53, facing each other. On the one hand, the first delay unit 54 delays the radio signal and then pass the delayed radio signal on to a third output port (OP5). On the other hand, the second delay unit 55 delays the radio signal and then send them out to a fourth output port (OP6). Ideally, the phase difference between output signals at the OP5 and the OP6 is constant.

When the power divider 51 divides the radio signal into two parts in the ratio of 1 to 2, the intensity of one part fed into the second phase shift 53 is two times stronger than that of the other part fed into the first phase shift units 52. That is, one part of the power divider 51 has a degree of zero and an amplitude of 1 (i.e., 1<0). The other part of the power divider 52 has a zero degree and an amplitude of 2 (i.e., 2<0).

The radius of a circular shape formed by the microstrip transmission line making up the first phase shift units 52 is roughly 3 times larger than that of the second phase shift units 53. If the phase of the radio signal received via the IP is not changed, The output signals at the OP3, OP5, OP6 and OP4 are outputted at the same time.

When the first and second phase shift units 52 and 53 are rotated by certain degrees, the phase difference between input and output signals at the OP3, OP5, OP6 and OP4 are 3 $\Theta/2$ , $\Theta/2$, $-\Theta/2$ and $-3\ \Theta/2$ respectively. That is, the OP3 has a degree of $+3\ \Theta/2$ and an amplitude of 0.5. The OP5 has a degree of $+\Theta/2$ and an amplitude of 1. The OP6 has a degree of $-\Theta/2$ and an amplitude of 1. The OP4 has a degree of $-3\ \Theta/2$ and an amplitude of 0.5. In this case, the phases of the adjacent output signals differ by $\Theta$.

Following from the above, the function of the first and second phase shift units 52 and 53 is to vary the phase of the radio signal fed into the antenna via the OP3 and OP6, thereby varying its power distribution.

However, the main drawback to the conventional phase shifter is that there is a need for an additional power divider capable of acquiring an output signal that has the same phase as the input signal. In addition, as the phase shift units are turned by certain degrees to vary the phase of the input signal, the radio signal fed into a metallic contact between a fixed part and a variant part is likely to go through an intermodulation. In this case, attainable variation in the angle of antenna beam tilt in vertical directions is limited largely due to a one-dimensional way the delay units delay the radio signal. Here, the delaying of the radio signal is done by making use of the distance between the radio signals.

SUMMARY OF THE INVENTION

It is, therefore, an object of the present invention to provide a phase shifter having a power dividing function.

It is another object of the present invention to provide a phase shifter for preventing inter modulation of a signal.

It is further another object of the present invention to provide a phase shifter having a larger range of variable angle of the beam tilt.

In accordance with an aspect of the present invention, there is provided a phase shifter, including: an input port for receiving a radio frequency (RF) signal; a power dividing means for dividing the RF signal into a first divided signal of which phase is to be varied and a second divided signal having a fixed phase value; a first output port for outputting the second divided signal having the fixed phase value; a phase shift unit for dividing the first divided signal into a third divided signal and a fourth divided signal wherein the third divided signal and the fourth divided signal move in opposite directions and for shifting phase of the third divided signal and the fourth divided signal based on a difference in a path length of the third divided signal and the fourth divided signal, to thereby generate phase-shifted signals; a phase delay means for delaying of the third divided signal and the fourth divided signal based on the phase-shifted signals; and at least two second output ports connected to the phase delay means, for outputting the phase-shifted signals.

The phase shifter includes: a first induction unit electrically connected to the first output port, wherein the first induction unit is a copper plate having a semicircle shape formed on the same plane as the input port; a second induction unit wherein the second induction unit is a copper plate having a ring shape formed on the same plane as the phase shift unit; and a dielectric located between the first induction unit and the second induction unit.

BRIEF DESCRIPTION OF THE DRAWINGS

The above and other objects and features of the present invention will become apparent from the following description of the preferred embodiments given in conjunction with the accompanying drawings, in which.

MODE(S) BEST FOR CARRYING OUT THE INVENTION

Other objects and aspects of the invention will become apparent from the following description of the embodiments with reference to the accompanying drawings, which is set forth hereinafter.

Figure 1:
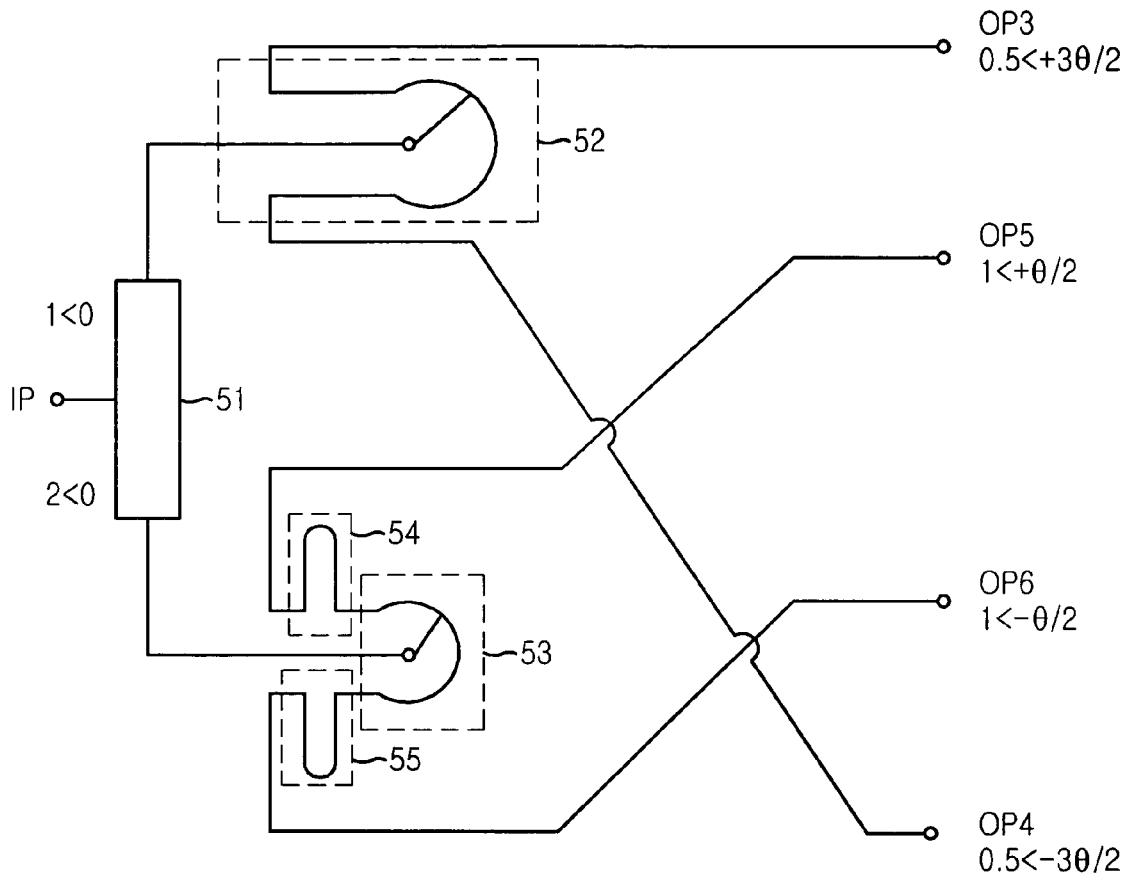
FIG.1 (PRIOR ART)
FIG. 1 is a diagram showing a conventional phase shifter.
Figure 2:
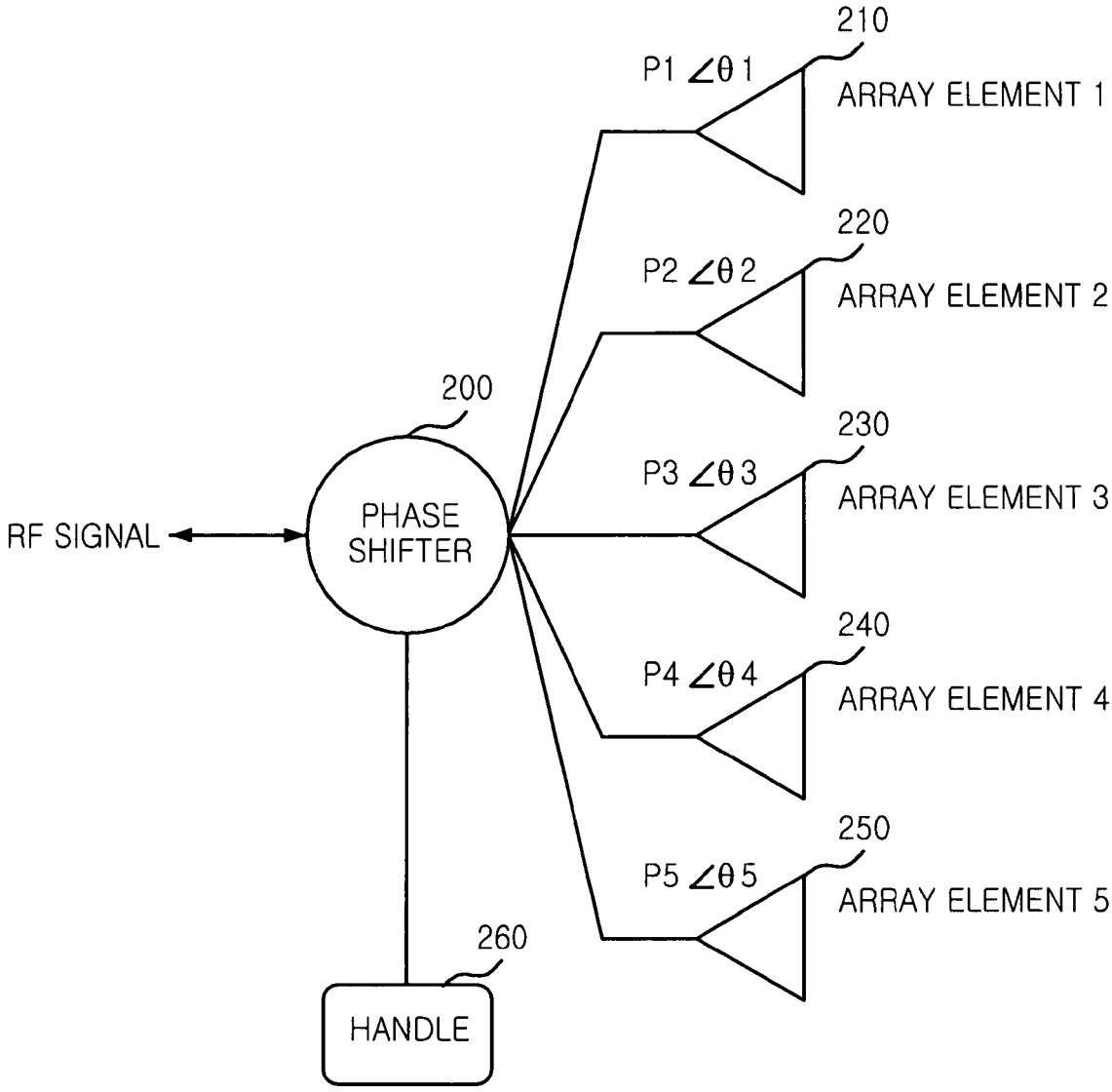
FIG. 2 is a diagram showing an electrical tilting antenna to which a phase shifter in accordance with the present invention is applied.

FIG. 2 is a diagram showing an electrical tilting antenna to which a phase shifter in accordance with the present invention is applied.

As shown, a phase shifter 200 is electrically connected to five antenna array elements numbered 210, 220, 230, 240 and 250. A first array element 1 (210) has a degree of Θ1 and an amplitude of P1. A second array element 2 (220) has a degree of Θ2 and an amplitude of P2. A fourth array element 4 (240) has a degree of Θ4 and an amplitude of P4. A fifth array element 5 (250) has a degree of Θ5 and an amplitude of P5. A handle 260 controls the phase shifter 200 in such a way that the phase difference between radio frequency (RF) signals fed into the array elements has a scale factor of Θ. In detail, the phase difference between two adjacent RF signals fed into the array elements is Θ. Typically, the handle 260 incorporates a remote-controlled step motor.

The phase shifter 200 includes a power dividing unit for dividing the RF input signal into separate output signals, each of which has a fixed phase value.

In this embodiment, the number of the array elements electrically connected to the phase shifter 200 is five (5). However, the number of the array elements is not limited.

Figure 3:
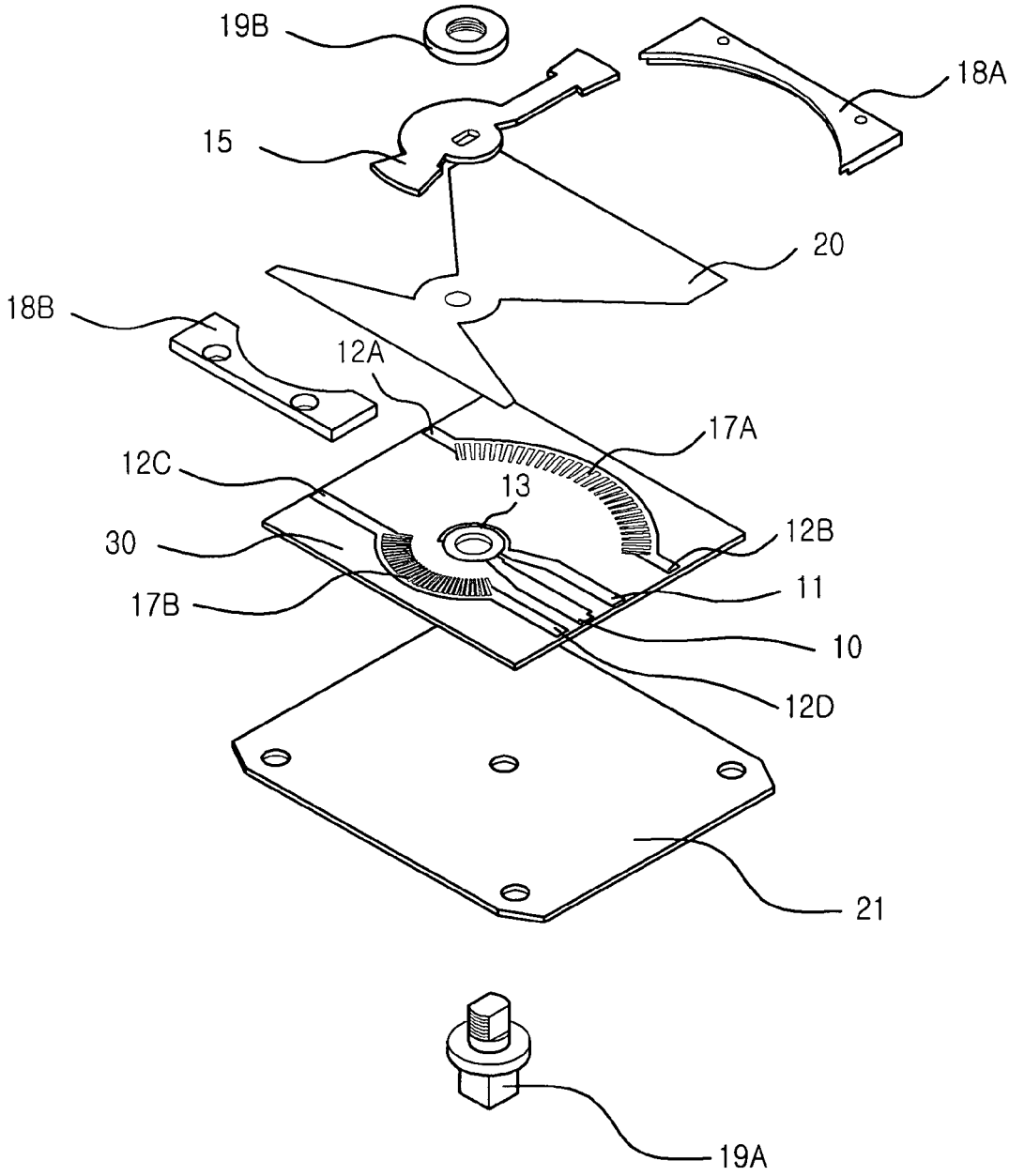
FIG. 3 is an exploded diagram illustrating a phase shifter in accordance with the present invention.

FIG. 3 is an exploded diagram illustrating a phase shifter in accordance with the present invention.

As shown, the phase shifter includes a basis plate 21, a circuit board 30, a dielectric 20, a phase shift unit 15, guide units 18A and 18B, a bolt 19A and a nut 19B.

The circuit board 30 is supported by the basis plate 21 made of copper. The circuit board 30 has, on one side, an input port 10, a first output port 11, phase delay units 17A and 17B, a first induction unit 13 and second output ports 12A, 12B, 12C and 12D. The first output port 11 outputs a signal that has a fixed phase value. The first induction unit 13 is semicircle in shape. The phase delay units 17A and 17B put together are shaped like a circle in full view. Each of the second output ports radiates a signal whose phase is variable.

The dielectric 20 transports an electric power by electromagnetic bond. The dielectric 20 is evaporated on the upper side of the circuit board 30. Teflon can be used as the dielectric 20.

The phase shift unit 15 is shaped like the hands of a clock, which are rotatable at a pivot point located on the center of the circuit board 30. On the underside of the phase shift unit 15 is located one copper plate facing the other copper plate mounted on the circuit board 30.

The bolt 19A and the nut 19B fasten together the phase shift unit 15 and the circuit board 30 so that the phase shift unit 15 turns around a pivot made up of the bolt 19A and the nut 19B. Here, the phase shift unit 15 turns either clockwise or counterclockwise by certain degrees. The turning motion of the phase shift unit 15 is guided by the guide units 18A and 18B.

Figure 4:
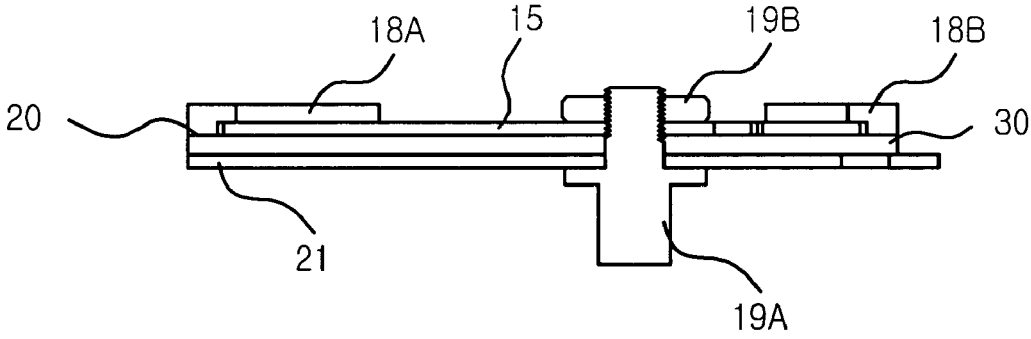
FIG. 4 is a schematic diagram illustrating a phase shifter in accordance with the present invention.

FIG. 4 is a schematic diagram illustrating a phase shifter in accordance with the present invention. The same reference numeral is given to the same element, although the element appears in different drawings, and may not be described in further detail.

As shown, a rotating shaft made up of a bolt 19A and a nut 19B goes through a basis plate 21, a circuit board 30, a dielectric 20 and a phase shift unit 15. The guide units 18A and 18B guide the rotating motion of the phase shift unit 15 so that the phase shift unit 15 is rotated within a predetermined angle.

Figure 5:
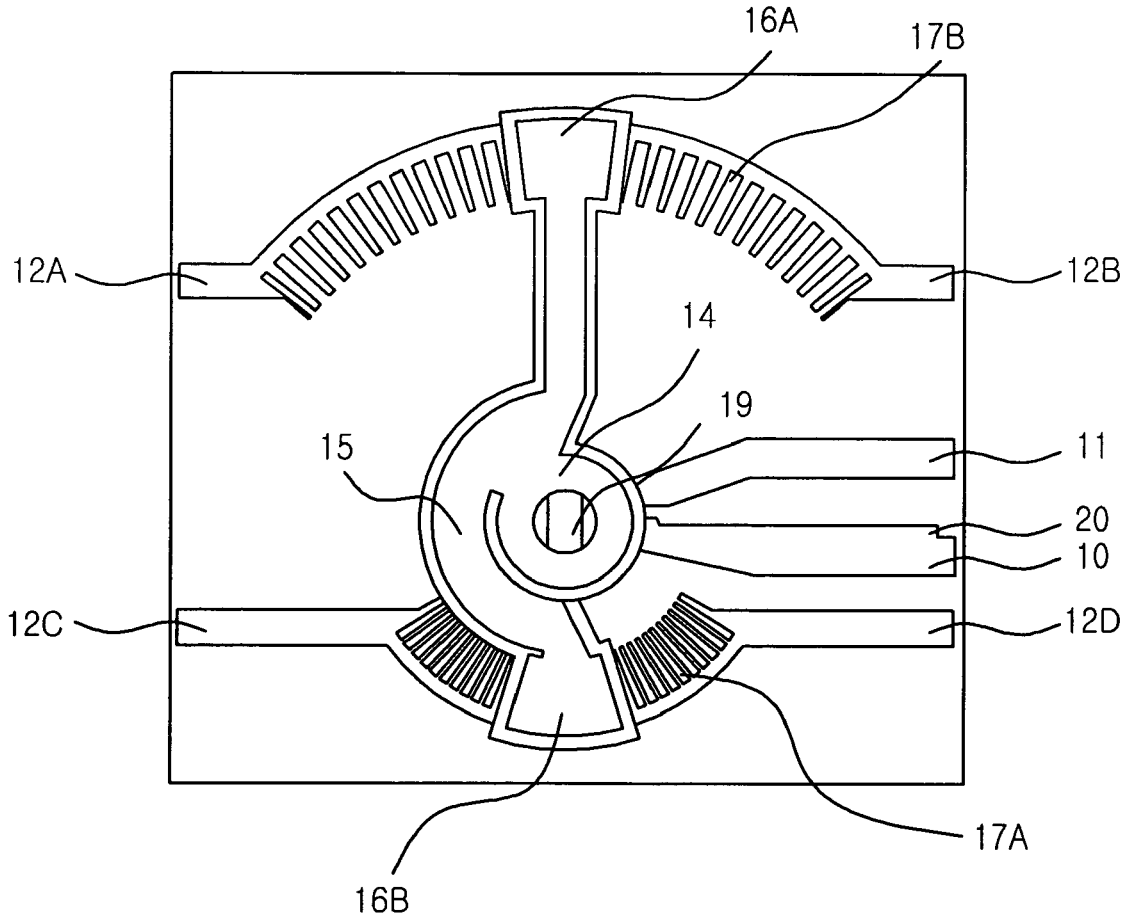
FIG. 5 is a front view illustrating a phase shifter in accordance with the present invention.

FIG. 5 is a front view illustrating a phase shifter in accordance with the present invention.

As shown, an image of a semicircular copper plate mounted on the underside of the phase shift unit 15 is projected onto the frontal view of the circuit board.

The function of the semicircular copper plate mounted on the bottom side of the phase shift unit 15 is to transfer an electric power from an input port 10 to the phase delay unit 17A or 17B. On the bottom side of the phase shift unit 15 is mounted the semicircular copper plate facing another semicircular copper plate mounted on the circuit board 30. The dielectric 20 is located between the two semicircular copper plates. The phase delay unit 17A or 17B includes a micro strip line and open stubs. The capacitance between the stubs and the circuit board ground plane causes the RF signal to be propagated slowly. Input impedance of the phase delay unit 17A or 17B is adjusted by the length of an open stub. The open stub is connected to one part of the input port 10, and the length and width of the open stub is adjusted so that the input port 10 has the impedance of 50Ω.

The operation of a phase shifter is described below in conjunction with FIGS. 3 to 5.

As an RF signal is fed into the input port 10, a power divider divides the RF signal into two parts. One part is a signal of which phase is variable. The other part is a signal having a fixed phase value. The power divider includes a first induction unit 13, a second induction unit 14 and a dielectric 20. The first induction unit 13 is a copper plate shaped like a semicircle and is mounted on the circuit board 30. The first induction unit 13 transmits a first divided signal to a first output port. The second induction unit 14 is a ring-shaped copper plate and is mounted on a side of the phase shift unit 15. The second induction unit 14 transmits the other divided signals to the phase delay unit 17*a* or 17*b*. The dielectric 20 is positioned between the first and second induction units 13 and 14.

Referring to FIG. 3, the input port 10, the induction unit 13 and the phase delay units 17A and 17B are formed on the same plane. Referring to FIG. 5, the second induction unit 14 and the phase shift unit 15 are formed on the same plane.

The one part of the RF input signal, a first divided signal, is transmitted to the first output port 11 via the first induction unit 13. The first divided signal has the same phase as the RF input signal. The other part of the RF input signal is transmitted to the phase delay units 17A and 17B via the second induction unit 14.

The power divider determines on how the electric power is shared between two different portions of the RF input signal. In which case, one portion has a fixed phase value and the phase of the other portion is to be shifted. Here, the power divider controls power energy of the first divided signal and the second divided signal by varying the length of the semicircular arc of the first induction unit 13 and the size of the second induction unit 14. Another embodiment of the present invention implements a phase shifter in which an input port 10 branches off to carry the portion of a RF input signal having a fixed phase value.

The RF signal from the phase shift unit 15 is fed into the phase delay units 17A and 17B. The RF signal from the phase delay unit 17A is divided into two parts moving away in opposite directions and is transmitted to the second output ports 12C and 12D. The RF signal from the phase delay unit 17*b* is divided into two parts moving away in opposite directions and is transmitted to the second output ports 12A and 12B. In which case, the way the RF signal is transferred from the phase shift unit 15 to the phase delay unit 17A is similar to that used in the power divider. In detail, the dielectric 20 transfers the electric power from the third induction units 16A and 16B to the phase delay units 17A and 17B.

Following from the above, the function of the dielectric 20 is to prevent metallic components from coming into contact with each other, thereby safeguarding against a signal intermodulation.

The electric power among the output ports is controlled by adjusting the width of the copper plate formed on the underside of the phase shift unit 15. In other words, the amount of power applied to the third induction unit is decided by the width and the length of the phase shift unit 15.

Figure 6:
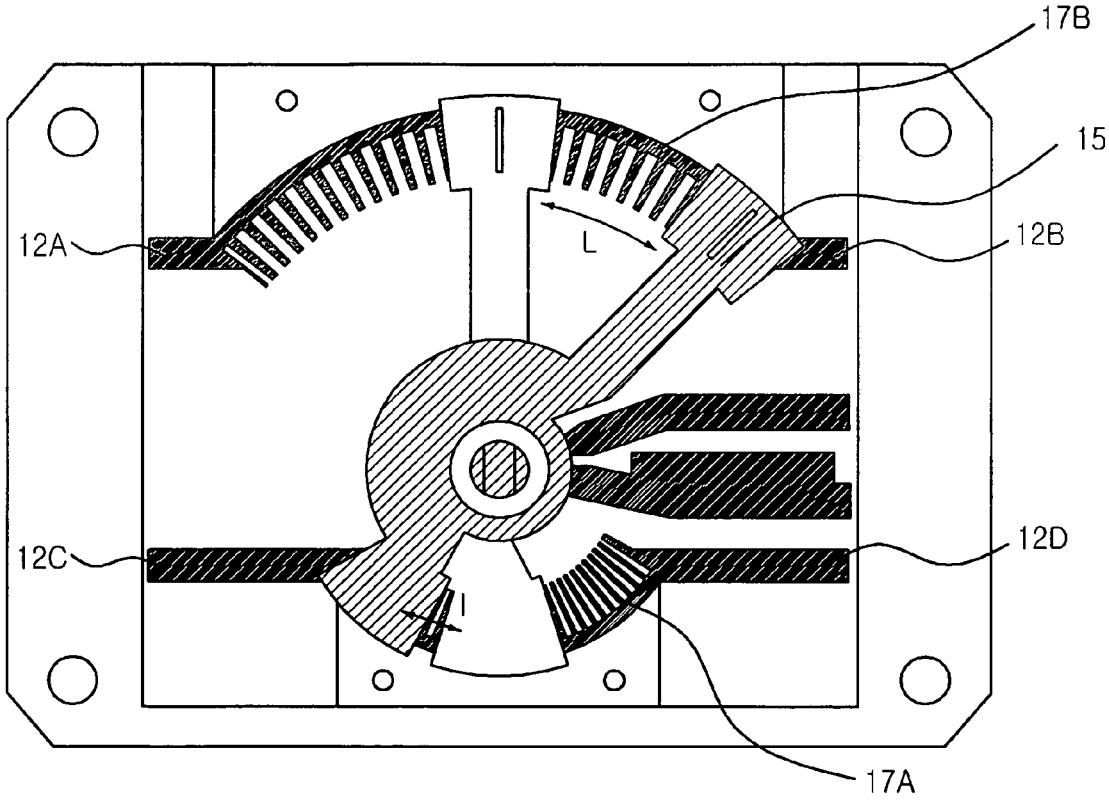
FIG. 6 is an exemplary view illustrating phase difference of output signals due to a phase shifter in accordance with the present invention.

FIG. 6 is an exemplary view illustrating phase difference of output signals due to a phase shifter in accordance with the present invention.

As the phase shift unit 15 turns clockwise by a certain degree, the path length of a RF signal fed into the phase delay units 17A and 17B varies. In which case, the path length of a RF output signal from the second output port 12*b* is shorter than that of a RF output signal from the second output port 12A by 2L, whereas the path length of a RF output signal from the second output port 12*d* is longer than that of the second output port 12C by 2*l*.

The phase delay units 17A and 17B are shaped like an arc-shaped comb. An output signal from each output port of the phase delay units 17A and 17B has a different phase value. This is due to the fact that the radius of the arc formed by the phase delay unit 17A differs from that of the phase delay unit 17B.

The phase of the output signal from the second output ports 12A, 12B, 12C or 12D is shifted by varying the angular degrees by which the phase shift unit 15 turns. Referring to FIG. 2, a phase shifter proposed by the present invention produces output signals that have phase values of θ1, θ2, θ3 and θ4.

Figure 7:
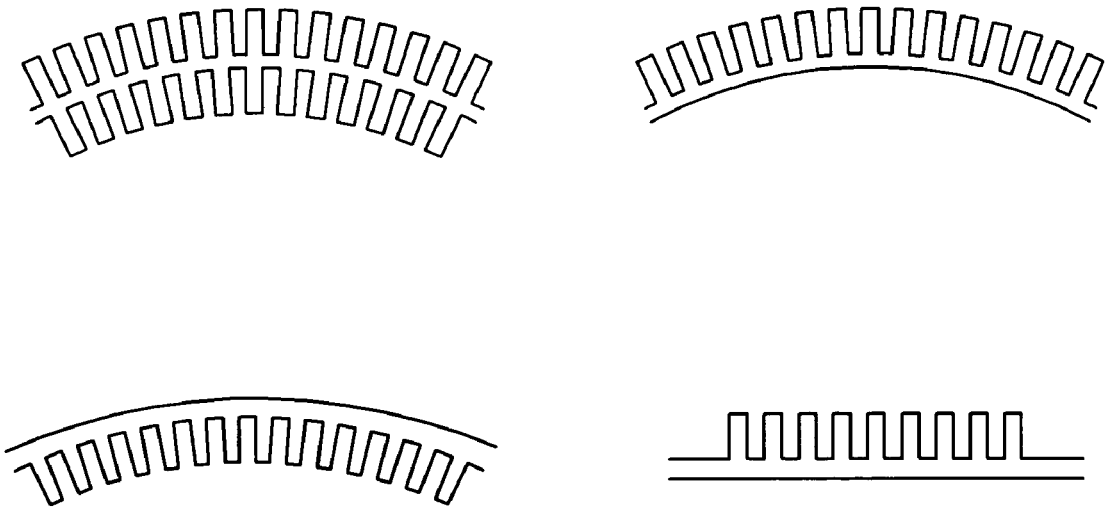
FIG. 7 is a diagram illustrating multiple phase delay units of the phase shifter in accordance with the present invention.

Unlike in a rod-shaped phase delay unit included in a conventional phase shifter, the phase delay units 17A and 17B are shaped like an arc-shaped comb so that a signal delay is maximized. In other words, since a small change in the angular displacement made by the phase shift unit 15 makes a big difference in delay of the signal, thereby maximizing the beam tilt of an antenna in vertical directions. FIG. 7 shows multiple phase delay units of the phase shifter in accordance with the present invention.

Figure 8:
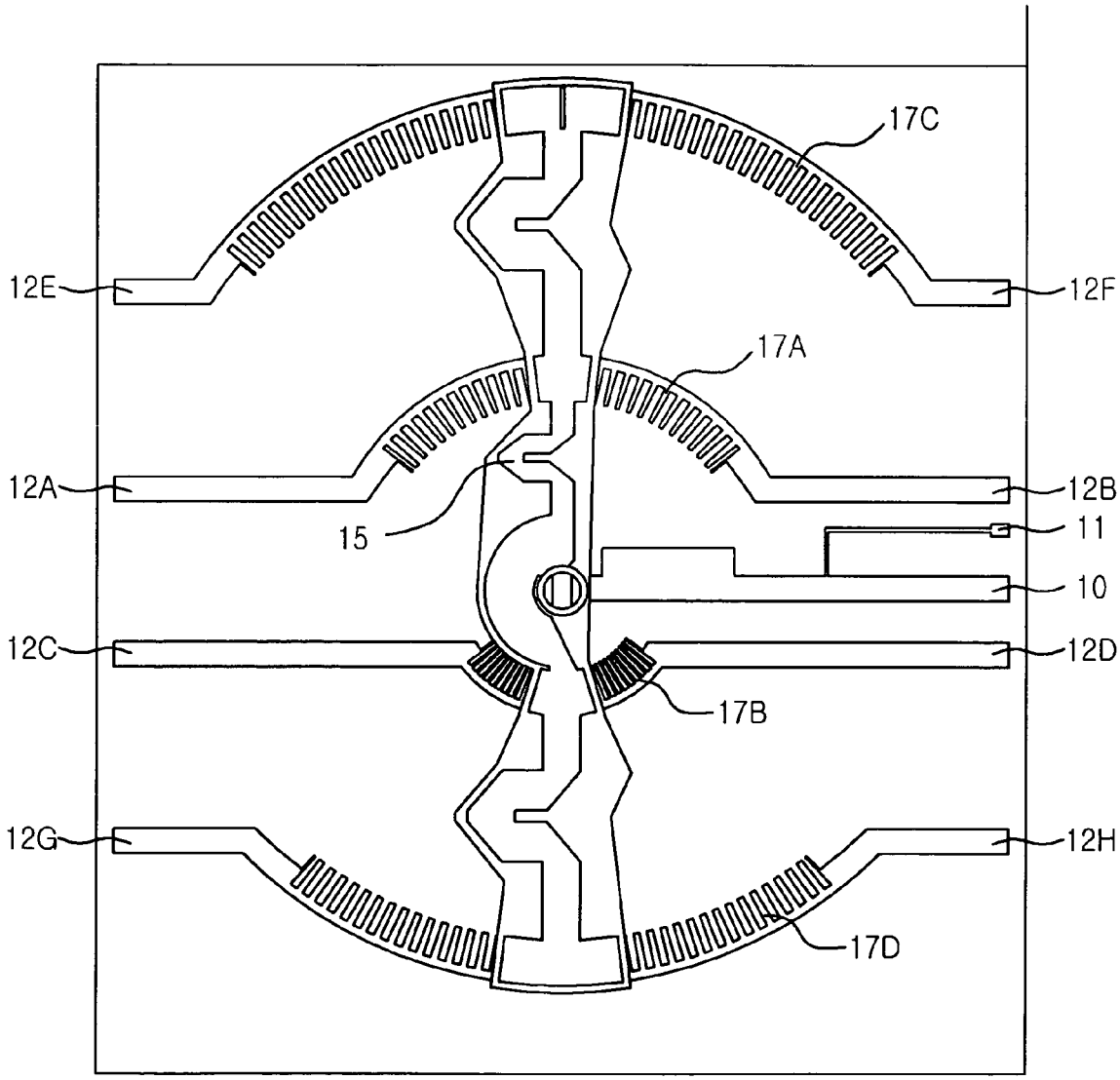
FIG. 8 is a front view illustrating a phase shifter in accordance with another embodiment of the present invention.

FIG. 8 is a front view illustrating a phase shifter in accordance with another embodiment of the present invention.

As shown, the phase shifter includes a first output port 11, second output ports 12A, 12B, 12C, 12D, 12E, 12F, 12G and 12H and phase delay units 17A, 17B, 17C and 17D. Each phase delay unit 17A, 17B, 17C or 17D has a different radius and has a repeated pattern. As is described in the preceding embodiments of the present invention, the phase shifting of a RF signal is effected by rotating the phase shift unit 15. The operation of the phase shifter having 9 output ports is similar to that of a phase shifter having 5 output ports. Accordingly, for only easy description, detailed description of the phase shifter having 9 output ports will be skipped.

Following from the above, the number of phase shift units incorporated in a phase shifter is varied according to the number of output ports. In which case, the phase shifting of an input signal comes in a many varieties.

Figure 9:
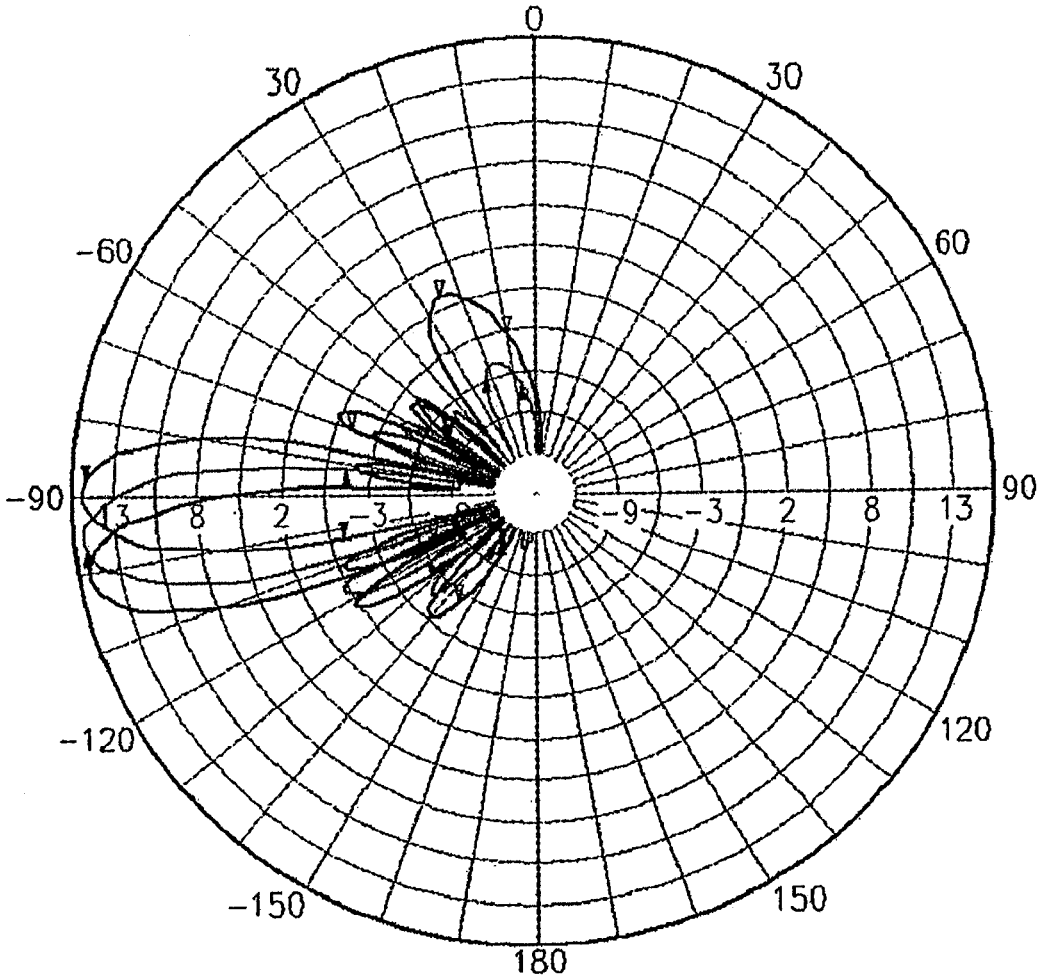
FIG. 9 is a view illustrating vertical beam patterns obtained by controlling an electrical tilting apparatus having five output ports in accordance with another embodiment of the present invention.
Figure 10:
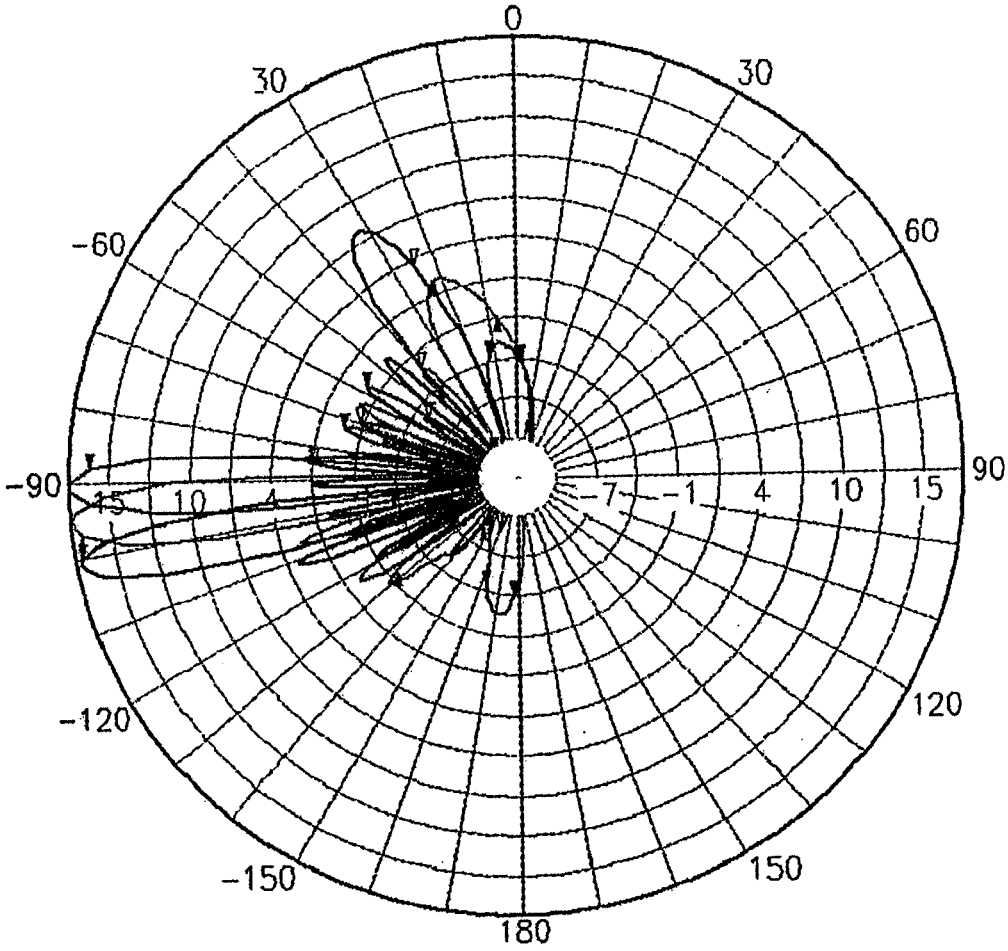
FIG. 10 is a view illustrating vertical beam patterns obtained by controlling an electrical tilting apparatus having five output ports in accordance with another embodiment of the present invention.

FIG. 9 is a view illustrating vertical beam patterns obtained by controlling an electrical tilting apparatus having five output ports in accordance with an embodiment of the present invention. FIG. 10 is a view illustrating vertical beam patterns obtained by controlling an electrical tilting apparatus having five output ports in accordance with another embodiment of the present invention.

As shown in FIGS. 9 and 10, the phase shifter in accordance with the present invention changes angles of radiation patterns of the antenna, without the mechanical beam tilt.

In a phase shifter proposed by the present invention is included a dielectric for preventing metallic components from coming into contact with each other, thereby safeguarding against a signal intermodulation.

The phase shifter has a power dividing unit for outputting a signal having the same phase as the input signal, to thereby manufacture a small size of the phase shifter having the power dividing function.

In the phase shifter, the dielectric is inserted between the fixed element and the variable element so as to electromagnetically transfer a signal, thereby preventing inter modulation of the signal.

Unlike in a rod-shaped phase delay unit included in the conventional phase shifter, the phase shifter in the present invention includes phase delay units that are shaped like an arc-shaped comb, distances between the signals between the output ports and the phase shift unit are larger so that a signal delay is maximized. Accordingly, a range of variable angle of the beam tilt of the antenna is larger than the conventional phase shifter.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A phase shifter, comprising:

an input port for receiving a radio frequency (RF) signal;

a power dividing means for dividing the RF signal into a first divided signal of which phase is to be varied and a second divided signal having a fixed phase value;

a first output port for outputting the second divided signal having the fixed phase value;

a phase shift means for dividing the first divided signal into a third divided signal and a fourth divided signal wherein the third divided signal and the fourth divided signal move in opposite directions and for shifting phase of the third divided signal and the fourth divided signal based on a difference in a path length of the third divided signal and the fourth divided signal, to thereby generate phase-shifted signals;

a phase delay means for delaying the third divided signal and the fourth divided signal based on the phase-shifted signals; and at least two second output ports connected to the phase delay means, for outputting the phase-shifted signals.

2. The phase shifter as recited in claim 1, wherein the power dividing means includes:

a first induction unit electrically connected to the first output port, wherein the first induction unit is a copper plate having a semicircle shape formed on a common plane as the input port and the first induction unit transmits the second divided signal to the first output port;

a second induction unit wherein the second induction unit is a copper plate having a ring shape formed on a common plane as the phase shift means and the second induction unit transmits the first divided signal to the phase shift means; and a dielectric located between the first induction unit and the second induction unit.

3. The phase shifter as recited in claim 2, wherein the power dividing means controls power energy of the first divided signal and the second divided signal by varying the length of the semicircular arc of the first induction unit and the size of the second induction unit.

4. The phase shifter as recited in claim 2, wherein the phase delay means is a copper plate having a circle arc shape and is formed on the same plane with a plane of the input port; and wherein the phase shift means varies a path length of the RF signal fed into the phase delay means by rotating clockwise or counterclockwise about a pivot point located on the center of the circle arc shape.

5. The phase shifter as recited in claim 4, wherein the dielectric is located between the phase delay means and the phase shift means, to thereby transfer power by electromagnetic bond.

6. The phase shifter as recited in claim 5, wherein the phase delay means includes a plurality of copper plate patterns each having a different radius formed on a common plane of the phase delay means and an arc-shaped comb shape, and generates phase-shifted signals based on angular degrees by which the phase shift means rotates.

7. The phase shifter as recited in claim 4, wherein the phase shift means controls power energy outputted from the third divided signal and the fourth divided signal in proportion to the length and width of the phase shift means.

8. The phase shifter as recited in claim 1, wherein the number of the second output ports is eight.

9. The phase shifter as recited in claim 1, wherein the number of the second output ports is four.

10. The phase shifter as recited in claim 1, wherein the power dividing means includes:

a first induction unit electrically connected to the first output port, wherein the first induction unit is a plate having a semicircle shape formed on a common plane as the input port and transmits the second divided signal to the first output port;

a second induction unit, wherein the second induction unit is a plate having a ring shape formed on a common plane as the phase shift means and transmits the first divided signal to the phase shift means; and a dielectric located between the first induction unit and the second induction unit.

11. The phase shifter as recited in claim 10, wherein the power dividing means controls power energy of the first divided signal and the second divided signal by varying the length of the semicircular arc of the first induction unit and the size of the second induction unit.

12. The phase shifter as recited in claim 1, wherein the phase delay means is a plate having a circle arc shape and is formed on the same plane with a plane of the input port; and wherein the phase shift means varies a path length of the RF signal fed into the phase delay means by rotating clockwise or counterclockwise about a pivot point located on the center of the circle arc shape.

13. The phase shifter as recited in claim 12, wherein a dielectric is located between the phase delay means and the phase shift means, to thereby transfer power by electromagnetic bond.

14. The phase shifter as recited in claim 13, wherein the phase delay means includes a plurality of plate patterns each having a different radius formed on a common plane as the phase delay means and an arc-shaped comb shape, and generates phase-shifted signals based on angular degrees by which the phase shift means rotates.

15. The phase shifter as recited in claim 12, wherein the phase shift means controls power energy outputted from the third divided signal and the fourth divided signal in proportion to the length and width of the phase shift means.

16. A phase shifter, comprising:

an input port for receiving a radio frequency (RF) signal;

a power dividing means for dividing the RF signal into a first divided signal and a second divided signal having a fixed phase value; and an output port for outputting the second divided signal having the fixed phase value;

wherein the first divided signal is divided into at least two signals, the at least two signals being shifted in phase based on a path length of the at least two signals, the power dividing means includes:

a first induction unit electrically connected to the output port;

a dielectric located on the first induction unit; and a second induction unit located on the dielectric.

17. The phase shifter as recited in claim 16, wherein the first induction unit has a semicircle shape;

and the second induction unit has a ring shape.

18. The phase shifter as recited in claim 17, wherein the power dividing means controls power energy of the first divided signal and the second divided signal by varying the length of the semicircular arc of the first induction unit and the size of the second induction unit.

19. A phase shifter, comprising:

a phase shift unit rotatable at a pivot point and feeding a radio frequency (RF) signal; and a phase delay unit for dividing the RF signal into two signals and shifting phases of the divided signals based on a path length.

wherein, the phase delay unit includes a arc-shaped conduction line and a plurality of open stubs extending from the arc-shaped conduction line.

20. The phase shifter of claim 19, further comprising an input port for receiving an input radio frequency (RF) signal;

a power dividing means for dividing the input RF signal into the RF signal and a second RF signal having a fixed phase value and;

a first output for outputting the second RF signal having the fixed phase value; and at least two second output ports connected to the phase delay unit, for outputting at least two divided signals from the RF signal which have phases that are shifted.

21. The phase shifter of claim 20, wherein the power dividing means includes:

a first induction unit electrically connected to the first output port, wherein the first induction unit has a semicircle shape;

a dielectric located on the first induction unit; and a second induction unit having a ring shape and located on the dielectric.

22. The phase shifter as recited in claim 21, wherein the power dividing means controls power energy of the first RF signal and the second RF signal by varying the length of the semicircular arc of the first induction unit and the size of the second induction unit.

23. The phase shifter as recited in claim 19, wherein a dielectric is located between the phase delay unit and the phase shift unit, to thereby transfer power by electromagnetic bond.

24. The phase shifter of claim 19, wherein the open stubs slow wave propagation to thereby increase phase-shifting range.

25. A phase shifter, comprising:

a phase shift unit rotatable at a pivot point and feeding a first radio frequency (RF) signal; and a phase delay unit formed in an arc-shaped comb for dividing the first RF signal into two signals, said phase delay unit shifting phases of the divided signals based on a path length, and delaying the divided signals based on the shifted phases.

26. The phase shifter of claim 25, further comprising an input port for receiving an input radio frequency (RF) signal;

a power dividing means for dividing the input RF signal into the first RF signal and a second RF signal having a fixed phase value and;

a first output port for outputting the second RF signal having the fixed phase value; and at least two second output ports connected to the phase delay unit, for outputting the divided signals.

27. The phase shifter of claim 26, wherein the power dividing means includes:

a first induction unit electrically connected to the first output port, wherein the first induction unit has a semicircle shape;

a dielectric located on the first induction unit; and a second induction unit having a ring shape and located on the dielectric.

28. The phase shifter as recited in claim 27, wherein the power dividing means controls power energy of the first RF signal and the second RF signal by varying the length of the semicircular arc of the first induction unit and the size of the second induction unit.

29. The phase shifter as recited in claim 25, wherein a dielectric is located between the phase delay unit and the phase shift unit, to thereby transfer power by electromagnetic bond.

* * * * *